United States Patent [19]

Pokhodnya et al.

[11] 4,350,311

[45] Sep. 21, 1982

[54] WIRE COILING MACHINE

[76] Inventors: Igor K. Pokhodnya, ulitsa Chkalova, 41-a, kv. 25; Valery N. Shlepakov, ulitsa Pushkinskaya, 45, kv. 9; Vladimir F. Alter, ulitsa Lenina, 88/92, kv. 77; Nikolai T. Ovcharenko, prospekt Nauki, 103, korpus 3, kv. 53; Igor P. Kaplienko, ulitsa Lenina, 88/92, kv. 66; Petr I. Rak, ulitsa Dobrokhotova, 6, kv. 17-a, all of Kiev, U.S.S.R.

[21] Appl. No.: 207,790

[22] Filed: Nov. 17, 1980

[51] Int. Cl.[3] ..... B21C 47/00

[52] U.S. Cl. ..... 242/83; 242/84; 83/315; 83/907

[58] Field of Search ..... 242/83, 84, 48, 19, 242/25 R, 25 A; 72/129; 83/315, 605, 907

[56] References Cited

U.S. PATENT DOCUMENTS

| | | | |
|---|---|---|---|
| 1,213,480 | 1/1917 | Hart | 83/907 X |
| 2,525,097 | 10/1950 | Hasler et al. | 242/19 |
| 2,957,640 | 10/1960 | Lewis, Jr. | 242/83 |
| 2,981,494 | 4/1961 | Kovaleski | 242/83 |
| 3,088,690 | 5/1963 | Haugwitz | 242/83 |
| 3,370,491 | 2/1968 | Cross | 83/315 X |
| 3,542,307 | 11/1970 | Schuetz | 242/83 |
| 4,302,994 | 12/1981 | Kramp et al. | 83/907 |

*Primary Examiner*—John M. Jillions

[57] ABSTRACT

In a wire coiling machine, wherein wire is continuously formed into coils, comprising a wire bundling assembly mounted on a frame and including a coil forming capstan and an accumulator drum axially mounted under the capstan and surrounded by a rotatable enclosure an improvement which comprises a wire cutting assembly including a percussion cutter unit mounted on the frame for rotation around a vertical axis and an anvil formed as a ring mounted on either the capstan or the accumulator drum and having a surface of revolution for taking an impact load from the cutter unit when the wire is cut at the instant a bundle of wire coils has been deposited. A wire receiving arrangement known to the art is placed below the wire bundling assembly to receive wire coils that have been laid in bundles.

5 Claims, 5 Drawing Figures

WIRE COILING MACHINE

BACKGROUND OF THE INVENTION

1. Field of the Invention

The present invention relates to wire coiling machines which form wire into coils and deposit the same in bundles suitable for a subsequent use. More specifically, it pertains to improvements in wire coiling machines which are preferably adapted for use in coiling flux-cored wire employed in welding and which machines can be used for withdrawing wire from wire draw benches.

2. Description of the Prior Art

Known in the art is a wire coiling machine which is disclosed in U.S. Pat. No. 2,981,494 granted Apr. 25, 1961 to Joseph J. Kovaleski. The prior art machine comprises a wire bundling means mounted on a frame and including a rotatable coil forming capstan and an accumulator drum mounted below the capstan in axial alignment therewith and rotated in a fixed rotational ratio to the capstan. The accumulator drum is provided with movable normally extended support fingers whereon, in operation, wire coils from the continuously rotating capstan are accumulated. The movable support fingers are retracted and extended by a suitable means, whereby the accumulated wire coils are free to fall down (the support fingers are retracted) and wire coils are accumulating (the support fingers are extended). The prior art wire coiling machine has a wire receiving means which is placed axially below the wire bundling means and including a turntable on which a wire receiving drum is removably mounted. The drum is normally formed with a cylindrical core around which the coils of wire are dropped.

In the operation of the prior art wire coiling machine, wire is fed to the capstan and cast into coils there, which coils are fed downwardly into engagement with the wire receiving drum, which is being rotated at the same speed as the capstan or in a fixed ratio relative the same. After the wire receiving drum has been filled, the wire between the capstan and wire receiving drum is severed by any means known to the art, the rotation of the turntable carrying this drum is stopped. The filled wire receiving drum is then removed from the turntable and a new wire receiving drum is provided in its place. Then the wire coiling operation is repeated to simultaneously fill the wire receiving drum.

In the operation of the prior art wire coiling machine difficulties relating to the wire cutting operation are encountered. In a continuous operation of the wire coiling machine, the wire cutting operation is complicated in that it is to be effected over a wide range of wire coiling speeds on moving wire of greatly differing gauges. In this case, the higher the speed of wire coiling, the more distorted is the leading end of the next coil following the cutting operation. Distortion of the wire usually involves distortion of the coil, but if comes to the worst, the wire coiling process is disturbed, that is the wire is driven out of the coil forming zone and the machine has to be stopped, which naturally affects performance characteristics of the pertinent equipment.

SUMMARY OF THE INVENTION

It is an object of the present invention to provide an improved wire coiling machine including a wire bundling means and a wire cutting assembly, in which provision is made for a continuous operation.

It is also an object of the invention to provide an improved wire coiling machine adapted for continuously and flawlessly forming wire into coils and depositing the same in bundles of different sizes.

It is still another object of the invention to provide an improved wire coiling machine in which provision is made for depositing wire coils in bundles of different sizes irrespective of the wire receiving means employed therewith.

It is further an object of the invention to provide an improved wire coiling machine which is of a simpler construction and, consequently, more dependable.

These and other objects of the invention are attained by providing a wire coiling machine comprising a frame, a wire bundling means mounted on the frame and including a rotatable coil forming capstan and an accumulator drum mounted below the capstan in axial alignment therewith and rotated in a fixed rotational ratio to the capstan and including movable normally extended support fingers for accumulating wire coils that come from the continuously rotating capstan wherein the improvement comprises a wire cutting assembly disposed at the level where deposition of wire coils in a bundle is terminated and including a percussion cutter unit mounted on the frame for rotation around a vertical axis and an anvil associated with the wire bundling means for rotation around the axis of rotation of the same wire bundling means and having a surface of revolution for taking an impact load from the cutter unit when the wire is cut at the instant a bundle of wire coils has been deposited.

Such an arrangement permits wire coils to be laid in bundles of different sizes and of a predetermined wire length. The wire cutting assembly comprising a cutter unit rotatable about a vertical axis, makes it possible to eliminate wire distortion thus leading to a lower fraction defective. Also, due to the wire cutting assembly consisting of two parts of which one (the cutter unit) is mounted on the frame and the other (the anvil) is associated with the wire bundling assembly, wire is cut so that the cutter unit under no circumstances interfere with the bundling process. On the other hand, such a cutter unit makes it possible to employ any wire receiving means known to the art with the machine of the invention.

In the wire cutting assembly the cutter unit preferably comprises a carrier member rotatable around a vertical axis stationary with respect to the frame. On the carrier member there is an electromagnet, the core of which carries a cutter at one end thereof and elastic members at the other, whereby the core is linked with the carrier member and the frame. This embodiment features a dependable operation due to its simple structure.

The other part of the wire cutting assembly, namely the anvil, is a ring mounted on either the accumulator drum or the capstan. When the accumulator drum is rotated at a lower speed than the capstan, it is practicable that the outer diameter of the anvil be equal to that of the capstan or greater than that of either the capstan or the accumulator drum. Such an anvil provides for the initial speed of rotation of the carrier member about its own axis, which speed is equal to or greater than that of the moving wire. This ensures the wire cutting operation irrespective of the speed at which the accumulator drum rotates.

BRIEF DESCRIPTION OF THE DRAWINGS

A preferred embodiment of the invention will now be described with reference to the accompanying drawing in which.

DESCRIPTION OF THE PREFERRED EMBODIMENT

Figure 2:
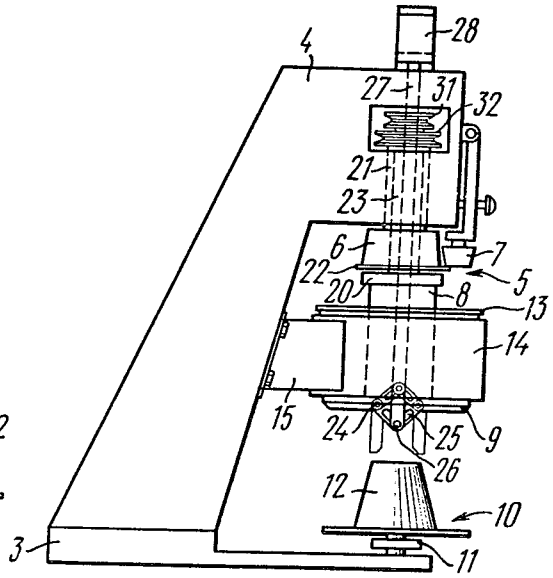
FIG. 2 is a side elevational view of the wire coiling machine of the invention.
Figure 1:
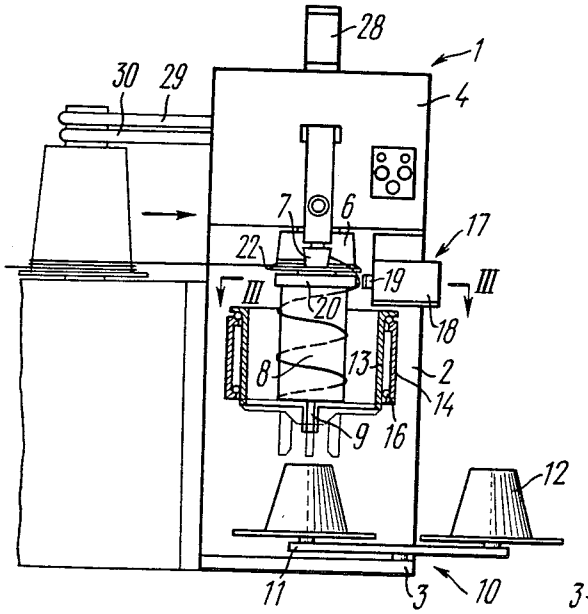
FIG. 1 is a front elevational view of the wire coiling machine of the invention.

Referring to FIGS. 1 and 2, a wire coiling machine is shown as utilized for withdrawing wire from wire draw benches and is generally indicated by the numeral 1, while a portion of a wire draw bench is shown in thin lines in FIG. 1. The machine basically comprises an upstanding frame consisting of a column 2, a base member 3 and an overhanging head portion 4. The head portion 4 carries a wire bundling means generally indicated by the numeral 5 and including a coil forming capstan 6, a pressure roller device 7 for applying a cast to the wire and maintaining the coils of wire, formed thereby, in feeding relation with the capstan 6. Also, the wire bundling means 5 includes a rotatable accumulator drum 8 mounted below the capstan 6 in axial alignment therewith and provided with movable normally extended support fingers 9 for accumulating wire coils thereon.

Mounted on the base member 3 and below the wire bundling means 5 is a wire receiving means 10 comprising a supporting means 11 rotatable about a vertical axis and carrying two drums 12 adapted to receive wire coils that have been deposited in bundles.

The accumulator drum 8 is surrounded by an enclosure 13 for the wire, the enclosure being shown here in the form of a cylindrical wall mounted in axial alignment with the drum 8 on a support ring 14 secured to a bracket 15 which in turn is secured to the column 2. The enclosure 13 via balls 16 is supported on the support ring 14 for rotation therein together with the support fingers 9 through engagement therewith as by tongue-and-groove joint (not shown as being conventional).

In accordance with the invention the machine is provided with a wire cutting assembly 17 disposed at the level where deposition of wire coils in a bundle is terminated. This level in this illustrated embodiment is found to be at transition from the capstan to the accumulator drum. The wire cutting assembly 17 comprises a percussion cutter unit 18 having a cutter 19, and an anvil 20 associated with the wire bundling means 5 for rotation about the axis of rotation of the same wire bundling means and having a surface of revolution for taking an impact load from the cutter unit 18.

Referring now to FIG. 2, a more detailed though somewhat schematic description of the wire bundling means 5 and the method of mounting the same on the frame, is given. The capstan 6 is seated on a hollow shaft 21 (shown in dotted lines in FIG. 2) and is provided on its outer surface with a circumferential rib 22 defining the lower peripheral edge of its body.

In the present embodiment the capstan 6, as described, is not the only possible structure. It is to be readily understood by those skilled in the art that the capstan may be provided with the rib defining its upper peripheral edge, the difference being in the way the wire coils are formed, namely the capstan 6 forms the wire coils upwardly, while the other just mentioned capstan forms the same downwardly.

The accumulator drum 8 is mounted below the capstan 6 on a hollow shaft 23 extending through the hollow shaft 21 and the capstan 6 as shown in dotted lines in FIG. 2. On the accumulator drum 8 at the upper extremity thereof is the anvil 20 constructed as a ring fit on said portion, though the anvil may be likewise integral with the body of the accumulator drum 8. The outer diameter of the anvil ring 20, as shown in FIG. 1, is equal to that of the capstan 6 or may exceed the same.

Referring to FIGS. 1 and 2, the support fingers 9 are disposed below the accumulator drum 8 and connected to means for retracting and extending the same fingers. Each support finger 9 is a double-arm lever rotatable about a pin 24 connected to the accumulator drum 8 in a conventional manner. Like arms of the levers forming support fingers 9 have a longitudinal slot 25 each and interconnected with a pin 26 extending in and out of the slots 25, while the other arms of the support fingers 9 are formed as forks for supporting the wire coils that are accumulating. This last feature is not shown in the drawing as obvious to those skilled in the art.

The means for retracting the movable normally extended support fingers 9 includes a rod 27 extending through the accumulator drum 8, the capstan 6, the hollow shaft 23 and driving means 28, which may be an air cylinder, the rod 27 being connected with the driving means 28 at one end thereof, while at the other end it is connected with the support fingers 9 as by the pin 26 secured to this other end.

Both the capstan and the accumulator drum are rotatably driven in this illustrated embodiment from the last drawing drum of the wire draw bench through vee-belt power transmissions 29 and 30 and through means for establishing a fixed rotational ratio between the capstan 6 and the accumulator drum 8, which means consisting of replaceable pulleys 31 and 32 of differing diameters, mounted on the shafts 23 and 21 respectively.

Figure 3:
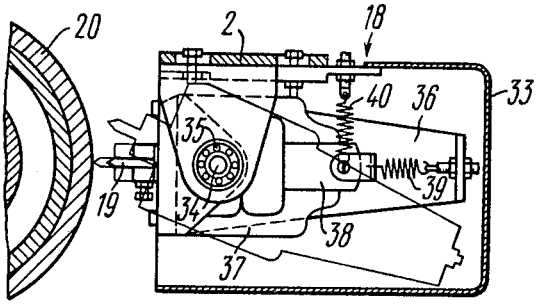
FIG. 3 is an enlarged cross-sectional view of the wire cutting assembly taken on the line III—III of FIG. 1.

A more detailed description of the wire cutting assembly 17 follows with reference to FIG. 3. The percussion cutter unit 18 is arranged in a casing 33 secured to the column 2. Mounted within the casing 33 and on a vertically extending shaft 34 journalled in bearings 35 is a carrier member 36 carrying an electromagnet 37 the core 38 of which at one end thereof (facing the wire bundling means 5) carries a cutter tool 19, while at the other end it is provided with elastic members such as extension springs 39 and 40. As can be seen in FIG. 3, the spring 39 connects the core 38 with the carrier member 36 and the spring 40 connects the same core with the frame, namely the column 2. In FIGS. 1 and 3 the anvil 20 is shown as a ring fitted onto the accumulator drum 8 at the level where deposition of wire coils in a bundle is terminated, in other words, at the level where the surface of the accumulator drum 8 extends downwardly of the capstan 6.

Figure 5:
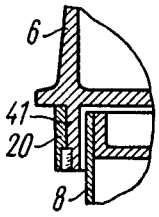
FIG. 5 is an enlarged fragmentary cross-sectional view of the wire bundling means according to the embodiment shown in FIG. 4.
Figure 4:
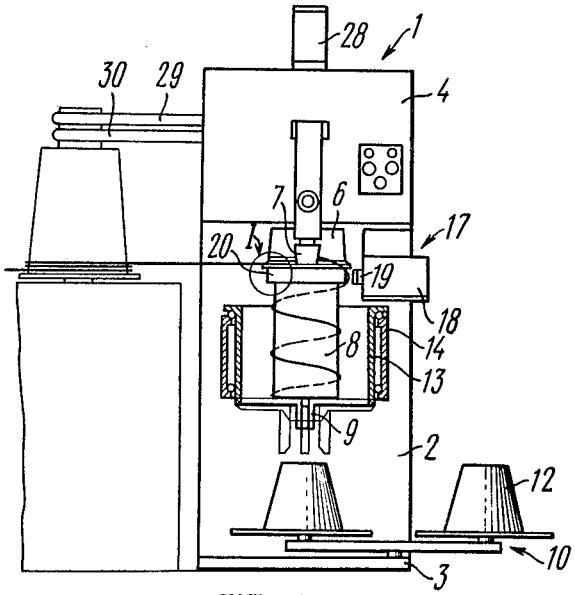
FIG. 4 is an embodiment similar but in part to that shown in FIG. 1.

According to an alternative embodiment illustrated in FIGS. 4 and 5 the anvil 20 is a ring mounted on the capstan 6. Since the capstan 6 has its lower extremity defined by the circumferential rib 22 which is over the level where deposition of wire coils in a bundle is terminated, it is provided with a skirt 41 with the anvil 20 fitted thereon. The outer diameter of the anvil 20 should be equal to or greater than that of the capstan 6. In this case the anvil 20 rotates at an angular speed which is equal to or higher than that of the capstan 6. Since the outer diameter of the anvil 20 is equal to or greater than that of the capstan 6, the linear speed of any point on the outer surface of the anvil 20, driving the cutter tool 19 of the cutter unit 18 due to the cutter tool coming in contact with the surface of the anvil at the moment of cutting the wire, is equal to or higher than that of the moving wire.

The machine, as described, operates as follows. Inasmuch as the machine just described is adapted for bundling wire by utilizing the drive of a wire draw bench, the following description of its operation will be based on this method, though, as evidenced by the prior art, the present arrangement may have inbuilt driving means.

When the wire draw bench is brought into operation, the capstan 6 and the accumulator drum 8 are rotatably driven by means of the vee-belt transmissions 29 and 30. Wire from the last drawing drum (shown in thin lines in FIG. 1) of the wire draw bench is fed to the capstan 6. A coil of wire which emanates from under the pressure roller 3 further is fed between the cutter tool 19 and the accumulator drum 8 to be deposited on the support fingers 9 of the accumulator drum 8.

By matching the replaceable pulleys 31 and 32 a rotational ratio between the capstan 6 and the accumulator drum 8 is preset, which ratio for the embodiment illustrated is in the range of 0.7 to 1.3. The diameter of the wire coils deposited in a bundle on the support fingers 9 may likewise be varied. If the rotational ratio of the capstan 6 to the accumulator drum 8 is less than unity, the diameter of the wire coils is less than that of the capstan 6, which makes it possible to use the accumulator drum 8 as a limiting means against radial displacement of the wire due to centrifugal force as it is laid in coils. But if the ratio just mentioned is greater than unity, the diameter of the wire coils is greater than that of the capstan 6. In this case radial displacement of the wire coils is limited by the rotatable enclosure 13.

After the wire coils have been deposited around the accumulator drum 8 to form a bundle, the wire is severed by means of the wire cutting assembly 17 and the support fingers 9 are retracted by the driving means 28.

The bundle is dropped by gravity on the drum 12 arranged axially below the accumulator drum 8, for further handling. Following removal of the bundle of wire the support fingers 9 via the driving means 28 are set into their normally extended position.

While the bundle of wire is being removed the coiling operation is continued as has been hereinbefore described.

To effect the wire cutting operation the electromagnet 37 is energized and therefore the core 38 with the cutter tool 19 is moved perpendicularly toward the moving wire, cuts the wire and thereby the cutter tool comes in contact with the rotating anvil 20. Since the electromagnet 37 is mounted on the freely rotatable carrier member 36 and due to the cutter tool 19 hitting the anvil 20, the carrier member 36 is instantly turned about its own axis in the direction of the wire motion and this drives the cutter tool 19 out of the wire path. When the electromagnet 37 is deenergized, the carrier member 36 and the core 38 assume their initial position by the action of the springs 39 and 40. As the cutter tool 19 returns into its initial position it does not interfere with the wire motion, because now it has already been moved out of the wire path.

The machine of the invention is a solution of the problem of continuously laying coils of wire in bundles of different sizes. Also, the machine of the invention operates without a specially built wire receiving arrangement particularly the one disclosed in U.S. Pat. No. 2,981,494, since in the present machine a wire receiving arrangement will always be loaded with the bundles of wire that have already been formed.

What is claimed is:

1. A wire coiling machine comprising:

a frame, a wire bundling means mounted on said frame and including a rotatable coil forming capstan, a rotatable accumulator drum mounted below said capstan in axial alignment therewith and including movable normally extended support fingers for accumulating wire coils that come from said continuously rotating capstan, means for retracting said movable normally extended support fingers, whereby the accumulated wire coils are free to fall down;

a wire cutting assembly disposed at the level where deposition of wire coils in a bundle is terminated and including a percussion cutter unit mounted on said frame for rotation around a vertical axis, an anvil associated with said wire bundling means for rotation around the axis of rotation of the same wire bundling means and having a surface of revolutions for taking an impact load from said cutter unit when the wire is cut at the instant a bundle of wire coils has been deposited;

means for establishing a fixed rotational ratio between said capstan and said accumulator drum, whereby wire coils of a desired size are invariably formed.

2. A wire coiling machine as in claim 1 wherein said cutter unit comprises a carrier member rotatable around said vertical axis stationary with respect to said frame, an electromagnet including a core which carries said cutter at one end thereof and elastic members at the other, whereby said core is linked with said carrier member and said frame.

3. A wire coiling machine as in claim 1 wherein said anvil is a ring mounted on said accumulator drum.

4. A wire coiling machine as in claim 1 wherein said anvil is a ring mounted on said capstan.

5. A wire coiling machine as in claim 3 wherein the outer diameter of said anvil is at least equal to that of said capstan.

* * * * *